US009245671B2

(12) United States Patent
Simpson et al.

(10) Patent No.: US 9,245,671 B2
(45) Date of Patent: Jan. 26, 2016

(54) ELECTRICALLY ISOLATED, HIGH MELTING POINT, METAL WIRE ARRAYS AND METHOD OF MAKING SAME

(75) Inventors: John T. Simpson, Clinton, TN (US); Joseph P. Cunningham, Oak Ridge, TN (US); Brian R. D'Urso, Pittsburgh, PA (US); Troy R. Hendricks, Holland, MI (US); Daniel A. Schaeffer, Knoxville, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 411 days.

(21) Appl. No.: 13/420,205

(22) Filed: Mar. 14, 2012

(65) Prior Publication Data

US 2013/0240242 A1 Sep. 19, 2013

(51) Int. Cl.
*H01B 13/14* (2006.01)

(52) U.S. Cl.
CPC ..... *H01B 13/14* (2013.01); *Y10T 156/1002* (2015.01); *Y10T 156/1084* (2015.01)

(58) Field of Classification Search
CPC ... H01B 13/016; H01B 13/143; H01B 7/0275
USPC ..... 29/828, 825, 592.1, 729; 174/88 R, 88 C, 174/70 R
See application file for complete search history.

(56) References Cited

U.S. PATENT DOCUMENTS 2,092,647 A * 9/1937 Hobart ..... H01B 3/082 174/111
2,263,601 A 11/1941 Wendler
3,265,480 A 8/1966 Hicks
3,294,504 A 12/1966 Hicks, Jr.
3,451,861 A * 6/1969 Norman ..... G01K 1/12 136/230
3,483,072 A * 12/1969 Cox ..... C03B 37/026 264/DIG. 19
3,903,353 A * 9/1975 Pirooz ..... C03C 3/064 174/68.3
3,972,970 A * 8/1976 Taylor ..... B29C 44/322 264/171.14
4,005,168 A * 1/1977 Whitfill, Jr. ..... H01B 13/14 156/273.9
4,096,346 A * 6/1978 Stine ..... B29C 47/128 174/110 AR (Continued)

FOREIGN PATENT DOCUMENTS

EP 2148338 1/2010
JP 2003346641 12/2003
KR 1020060019849 3/2006

OTHER PUBLICATIONS

Bormashov et al., "Prediction of field emitter cathode lifetime based on measurement of I—V curves", Applied Surface Science (2003) 215: 178-184.

(Continued)

*Primary Examiner* — Peter DungBa Vo
*Assistant Examiner* — Kaying Kue
(74) *Attorney, Agent, or Firm* — Novak Druce Connolly Bove + Quigg LLP

(57) ABSTRACT

A method of making a wire array includes the step of providing a tube of a sealing material and having an interior surface, and positioning a wire in the tube, the wire having an exterior surface. The tube is heated to soften the tube, and the softened tube is drawn and collapsed by a mild vacuum to bring the interior surface of the tube into contact with the wire to create a coated wire. The coated wires are bundled. The bundled coated wires are heated under vacuum to fuse the tube material coating the wires and create a fused rod with a wire array embedded therein. The fused rod is cut to form a wire array. A wire array is also disclosed.

19 Claims, 10 Drawing Sheets

(56) References Cited

U.S. PATENT DOCUMENTS 4,305,900 A * 12/1981 Cavalli ..... B29C 47/02 156/461
4,415,635 A * 11/1983 Wilsdorf ..... H01R 39/24 310/248
4,588,546 A * 5/1986 Feil ..... B29C 47/02 156/244.12
4,826,726 A * 5/1989 Maeda ..... H01B 3/40 174/110 PM
4,985,313 A * 1/1991 Penneck ..... C23C 28/00 428/627
5,015,800 A * 5/1991 Vaupotic ..... H01B 11/002 156/51
5,045,526 A 9/1991 Nagesh et al.
5,110,998 A * 5/1992 Muschiatti ..... C08J 9/143 174/110 F
5,209,987 A * 5/1993 Penneck ..... C23C 14/027 428/457
5,229,357 A * 7/1993 Onishi ..... H01L 39/248 505/121
5,240,066 A 8/1993 Gorynin et al.
5,245,134 A * 9/1993 Vana, Jr. ..... G02B 6/4403 156/47
5,252,550 A * 10/1993 Yamauchi ..... H01L 39/248 174/125.1
5,336,851 A * 8/1994 Sawada ..... H01B 3/105 174/110 A
5,349,217 A 9/1994 Boysel
5,725,953 A * 3/1998 Onishi ..... H01B 3/303 174/110 FC
5,877,588 A 3/1999 Kaftanov et al.
6,229,259 B1 5/2001 Christensen, Sr.
6,273,977 B1 * 8/2001 Harden ..... H01B 13/0023 156/244.12
6,471,903 B2 * 10/2002 Sherman ..... B26F 1/24 249/64
6,478,997 B2 11/2002 McCullough
6,789,311 B2 * 9/2004 Fidi ..... H01F 27/323 29/605
7,045,069 B2 * 5/2006 Ozeryansky ..... A61M 37/0015 216/11
7,102,242 B2 9/2006 Brix et al.
7,150,904 B2 * 12/2006 D'Urso ..... B01L 3/0244 428/116
7,238,415 B2 7/2007 Rodriguez et al.
7,254,963 B2 * 8/2007 Deprot ..... C03B 37/026 65/444
7,258,731 B2 * 8/2007 D'Urso ..... B05D 5/083 106/2
7,292,758 B2 11/2007 Bayindir et al.
7,295,734 B2 11/2007 Bayindir et al.
7,696,437 B2 * 4/2010 Clark ..... H01B 7/0216 174/110 R
7,697,808 B2 * 4/2010 D'Urso ..... B82Y 20/00 359/361
7,745,984 B2 6/2010 Lee et al.
7,832,089 B2 * 11/2010 Perera ..... D01D 5/34 164/167
7,958,454 B2 6/2011 Gaudette
8,101,913 B2 * 1/2012 Ivanov ..... C03B 23/047 250/336.1
8,208,136 B2 * 6/2012 Ivanov ..... G01N 21/658 356/301
8,241,508 B2 * 8/2012 D'Urso ..... B01L 3/0244 216/11
8,404,976 B2 * 3/2013 Telley et al. ..... 174/115
8,460,782 B2 * 6/2013 Ivanov ..... C01B 31/0253 257/E21.09
8,461,600 B2 * 6/2013 Ivanov ..... H01L 51/4233 257/88
8,658,880 B2 * 2/2014 Dutta ..... B21C 1/003 136/201
2002/0185770 A1 12/2002 McKague
2004/0027377 A1 2/2004 Hays et al.
2004/0032194 A1 * 2/2004 Koga ..... B82Y 10/00 313/309
2004/0094503 A1 * 5/2004 Ozeryansky ..... A61M 37/0015 216/2
2004/0222010 A1 * 11/2004 Tonucci ..... H01B 13/065 174/110 R
2005/0053345 A1 3/2005 Bayindir et al.
2006/0263921 A1 11/2006 Nakamura et al.
2007/0019917 A1 1/2007 Bayindir et al.
2007/0092716 A1 4/2007 Guo et al.
2007/0131266 A1 6/2007 Dutta
2007/0131269 A1 6/2007 Dutta
2007/0245774 A1 * 10/2007 Dutta ..... H01L 35/16 65/393
2008/0042547 A1 2/2008 Chien et al.
2008/0080816 A1 * 4/2008 D'Urso ..... B82Y 20/00 385/77
2008/0087047 A1 4/2008 Bayindir et al.
2008/0138571 A1 6/2008 Sazio et al.
2008/0142075 A1 6/2008 Reddy et al.
2008/0169016 A1 * 7/2008 Dutta ..... H01L 31/035281 136/238
2008/0182317 A1 7/2008 Maquin et al.
2008/0223602 A1 * 9/2008 Gallucci ..... C08G 77/455 174/110 SR
2008/0254206 A1 * 10/2008 Perera ..... D01D 5/34 427/118
2009/0240271 A1 * 9/2009 Britton ..... A61F 9/00736 606/162
2010/0170694 A1 7/2010 Tsotsis
2010/0243292 A1 * 9/2010 Telley ..... H01B 13/0023 174/117 F
2011/0006204 A1 1/2011 Bower et al.
2011/0062410 A1 3/2011 Ivanov et al.
2013/0153112 A1 * 6/2013 Telley et al. ..... 156/47
2013/0241389 A1 * 9/2013 Kisner ..... H01J 21/10 313/296

OTHER PUBLICATIONS

Bower et al., "A micromachined vacuum triode using a carbon nanotube cold cathode", IEEE Transactions on Electron Devices (2002) 49(8): 1478-1483.
Branston et al., "Field emission from metal-coated silicon tips", IEEE Transaction on Electron Devices (1991) 38(10): 2329-2333.
Brunetti et al., "Realization of a carbon nanotube-based triode", Sixth IEEE Conference on Nanotechnology (2006). (4 pages).
Cheng et al., "Electron field emission from carbon nanotubes", C.R. Physique (2004) 4: 1021-1033.
International Search Report and the Written Opinion of the ISA mailed on Jun. 21, 2013 in PCT Application No. PCT/US2013/029874, international filed Mar. 8, 2013. (12 pages).
International Search Report and the Written Opinion of the ISA mailed on Jun. 27, 2013 in PCT Application No. PCT/US2013/029878, international filing date Mar. 8, 2013. (11 pages).
Koh et al., "Space-charge-limited bipolar flow in a nano-gap", Applied Physics Letters (2005) 87: 193112.
Lu et al., "A physical simulation model for field emission triode", IEEE Transactions on Electron Devices (1998) 45(10): 2238-2244.
Orvis et al., "Modeling and fabricating micro-cavity integrated vacuum tubes", IEEE Transactions on Electron Devices (1989) 36(11): 2651-2658.
Pirio et al., "Fabrication and electrical characteristics of carbon nanotube field emission microcathodes with an integrated gate electrode", Nanotechnology (2002) 13: 1-4.
Quy et al., "A high-performance triode-type carbon nanotube field emitter for mass production", Nanotechnology (2007) 18: 345201. (6 pages).
Reuss et al., "Cathode lifetime issues in field emission displays", Proc. Mat. Res. Soc. Symp. (2000) 558: 49-60.
Trujillo et al., "Effects of vacuum conditions on low frequency noise in silicon field emission devices", J vac. Sci. Technol. B (1997) 15(2): 402-404.
Wong et al., "Carbon nanotubes field emission integrated triode amplifier array", Diamond & Related Materials (2006) 15: 1990-1993.

* cited by examiner

ELECTRICALLY ISOLATED, HIGH MELTING POINT, METAL WIRE ARRAYS AND METHOD OF MAKING SAME

STATEMENT REGARDING FEDERALLY SPONSORED RESEARCH OR DEVELOPMENT

This invention was made with government support under DE-AC05-00OR22725 awarded by the United States Department of Energy. The government has certain rights in the invention.

FIELD OF THE INVENTION

This invention relates generally to metal wire arrays and more particularly to electrically isolated, high melting point wire arrays.

BACKGROUND OF THE INVENTION

Wire arrays have been produced by electroplating or other deposition of metals into microchannel glass. This method has problems with the continuity of the wires, and works with a limited range of materials and geometries. Individual microwires have been produced by the drawing of a glass tube with molten metal inside (known as the Taylor wire drawing process), or by drawing a solid wire into a fiber of glass.

SUMMARY OR THE INVENTION

A method of making a wire array device includes the steps of providing a tube of a sealing material, the tube having an interior surface; positioning a wire in the tube, the wire having an exterior surface; heating and softening the tube and drawing the softened tube to bring the interior surface of the tube into contact with the exterior surface of the wire to create a coated wire; bundling a plurality of the coated wires; and heating the bundled coated wires to fuse the sealing material coating the wires and create a fused rod with an array of the wires embedded therein.

The method of can include the step of cutting the fused rod into wafers. Prior to the drawing step, the tube can be heated and drawn to form a pre-form tube having an inside diameter less than the inside diameter of the tube. The drawing step can include first engaging and pulling the wire, and subsequently engaging and pulling the coated wire.

End portions of the sealing material can be removed to expose end portions of the wires. Portions of the exposed wires can be removed to form a pointed end. The removal step can be by etching. The pointed wires can be bent such that the axis of the pointed end is at least 30 degrees from the axis of the wire.

The parameters of the draw can be selected such that in the absence of the metal wire the inside diameter of the drawn tube would be similar to or smaller than the diameter of the wire. The diameter of the wire can be between 1 and 200 μM. The sealing material can be selected to wet the wire. The coefficient of thermal expansion (CTE) difference between the sealing material and the wire material can be $\Delta CTE<1-5\times10^{-7}/°$ C. The wire material can have a melting point higher than the melting point of the sealing material. The tube can be heated to a temperature that is less than the melting point of the wire ($T_m$), but above the glass transition temperature of the glass ($T_g$).

The sealing material can be a glass, such as a Tungsten sealing glass, for example. The glass can be at least one selected from the group consisting of Corning Pyrex, Schott 8330, Schott Fiolax, Schott 8487, or soda lime glass. The wire can be at least one selected from the group consisting of platinum, iridium, platinum-iridium alloy, stainless steel, tungsten, and mixtures or alloys thereof.

A vacuum can be applied to the tube during the drawing step. The tubes can be filled with a material other than the wire material and bundled with the coated wires prior to the fusing step. Hollow tubes can be bundled with the coated wires prior to the fusing step. Solid rods of the sealing material or another material can be bundled with the coated wires prior to the fusing step.

A wire array can include a plurality of wires embedded in a matrix of a sealing material, exposed end portions of the wires extending outward from the sealing material. The sealing material can be a glass. The glass can be at least one selected from the group consisting of Corning Pyrex, Schott 8330, Schott Fiolax, Schott 8487, or soda lime glass. The wire can include at least one selected from the group consisting of platinum, iridium, platinum-iridium alloy, stainless steel, tungsten, and mixtures or alloys thereof. The coefficient of thermal expansion (CTE) difference between the sealing material and the wire material can be $\Delta CTE<1-5\times10^{-7}/°$ C. The wire can be between 1 and 200 μM.

BRIEF DESCRIPTION OF THE DRAWINGS

A fuller understanding of the present invention and the features and benefits thereof will be obtained upon review of the following detailed description together with the accompanying drawings, in which.

Figure 1:
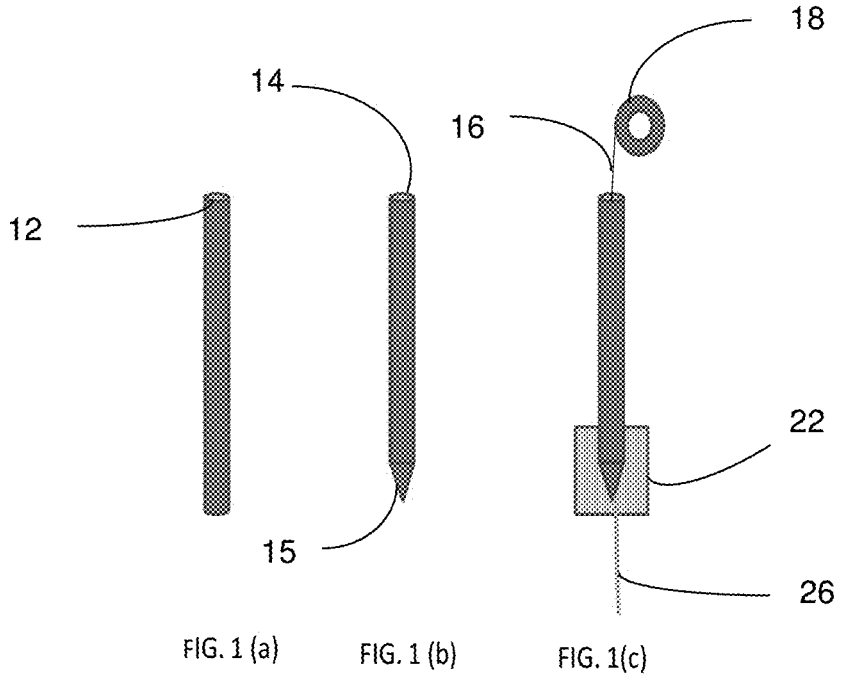
FIG. 1 is a schematic depiction of a drawing process according to an embodiment of the present invention.

For a better understanding of the present invention, together with other and further objects, advantages and capabilities thereof, reference is made to the following disclosure and appended claims in connection with the above-described drawings.

DETAILED DESCRIPTION

The invention provides a method of forming refractory wire arrays using a glass drawing process. This process uses a modified "Taylor Wire Drawing" technique to coat non-drawable wire (i.e. high melting point wire) in a sealing material such as glass. The wire is positioned in tubes of the sealing material and then heated such that the tube material wets and seals the wire. This produces glass coated wire fibers. These fibers are then bundled together and fused into a solid rod with the wires embedded in a glass matrix. The rod is cut into wafers. The wafers are etched to remove part of the matrix to expose tips of the wires whereby the wire array becomes fully exposed at the surface of the wafer and can be fashioned into a number of possible devices.

The sealing material should be drawable, should adhere to or "wet" the metal or other wire material, and should not adversely react with the metal or other wire material. The sealing material can be nonconductive. The sealing material may consist of almost any glass. The sealing glass should have a low viscosity at the drawing temperature. A low viscosity helps "wet" the metal. Also, the sealing glass or other material should have a coefficient of thermal expansion (CTE) that is relatively close to that of the metal or other wire material being coated, preferably $\Delta CTE<1-5\times10^{-7}/°$ C. The glass can be a sealing glass such as a Tungsten sealing glass. Examples of suitable glasses include Corning Pyrex (Corning, N.Y.), Schott 8330 (Elmsford, N.Y.), Schott Fiolax, Schott 8487, and soda-lime glasses. Other suitable materials include metals (including alloys), ceramics, polymers, resins, and the like. Polymers suitable for use should be thermoplastic. Choices of materials can have an effect on properties of the product, such as, for example, chemical resistance, ease and/or need of coating, strength, toughness, flexibility, elasticity, and plasticity.

The dimensions of the glass or other sealing material tubes can vary, as the invention can be scaled around larger wires or very small diameter wires. The upper limit of wire size is only limited to the inner diameter size of the tube. The lower limit is limited to the size (diameter) of the wire. Commercially available wires can be found with diameters as small as ~1 micron. Smaller wire sizes to 50 nm or less are possible. Wire dimensions in one aspect of the invention are between 1-200 μM, and smaller wires if available could be used.

The wire may consist of any metal which has a higher melting point than the desired glass or other sealing material. The metal may be platinum, iridium, a platinum-iridium alloy, stainless steel, tungsten, or another metal, and combinations thereof. The metal should preferably have a melting point above the glass transition point (softening point) of the were. Heat induced oxidation of the metal wire causes the wire to be very brittle and can cause it to break during the drawing process. Thus it may be necessary to coat the wire in an inert atmosphere (or vacuum).

The process begins with a glass tube and a length of metal wire which has a diameter smaller than the inside diameter of the tube. There is shown in FIG. 1 the wire drawing and coating process. A glass capillary tube 12 shown in FIG. 1*a* is heated in a furnace 22 of a glass drawing tower or by some other suitable heat source, to bring the temperature of the glass to above the glass transition temperature $T_g$ but below the melting temperature $T_m$ of the glass. The glass capillary tube can be lowered into the furnace or otherwise heated and drawn to create a partially drawn or pre-form tube 14 having a narrowed end 15, as shown in FIG. 1*b*. This tapering of the tube is the same process as in fabricating glass pipettes, a micropipette puller process. Characterization of the tapering process can be defined as glass diameter reduction rate per distance of the taper, such as mm reduction/cm or taper length.

Wire 16 is threaded as from a spool 18 at least partially through the pre-form tube 14 and drawn in a fiber draw tower or other suitable device. In the drawing process, the metal wire 16 and pre-form tube 14 are pulled through the furnace 22 and the wire 16 is coated by the softened glass to form a glass-coated wire 26. The draw parameters can include the feed rate—the rate at which the pre-form tube 14 is fed into the furnace, the draw rate—the rate at which coated wire is pulled through the furnace 22, the furnace temperature, and the vacuum pressure—a slight vacuum is used to remove air trapped within the tube 14, which helps to seal the glass to the wire.

The draw parameters can be chosen such that in the absence of the metal wire, the inside diameter of the drawn tube would be the same as or smaller than the diameter of the wire. The temperature of the draw is typically less than the melting point of the wire ($T_m$), but above the glass transition temperature of the glass ($T_g$). As the draw parameters for the glass are chosen to draw the tube opening smaller than the diameter of the wire, and the diameter of the wire does not substantially change in the process, the glass will be drawn tightly about the wire. In this manner, the glass will tightly coat the wire with a minimum of air pockets or other abnormalities at the glass-wire interface. Air can be removed from the tube via a vacuum pump, which can help collapse the tube around the wire.

A meter of glass tube can be used to coat many meters of wire. Runs of 50 to 100 meters or more of wire at a time are possible. The wire 16 is therefore provided on suitable structure such as the spool 18, which can feed long lengths of wire during the draw process. The wire 16 from the spool 18 is fed through the glass capillary pre-form tube 14, through the furnace 22, and into a puller. A varying amount of tension on the wire 16 is necessary during the startup process. Some tension is needed in order to prevent the spooled wire from unraveling. Once the drawing process stabilizes, the tension on the wire can be reduced.

Figure 2:
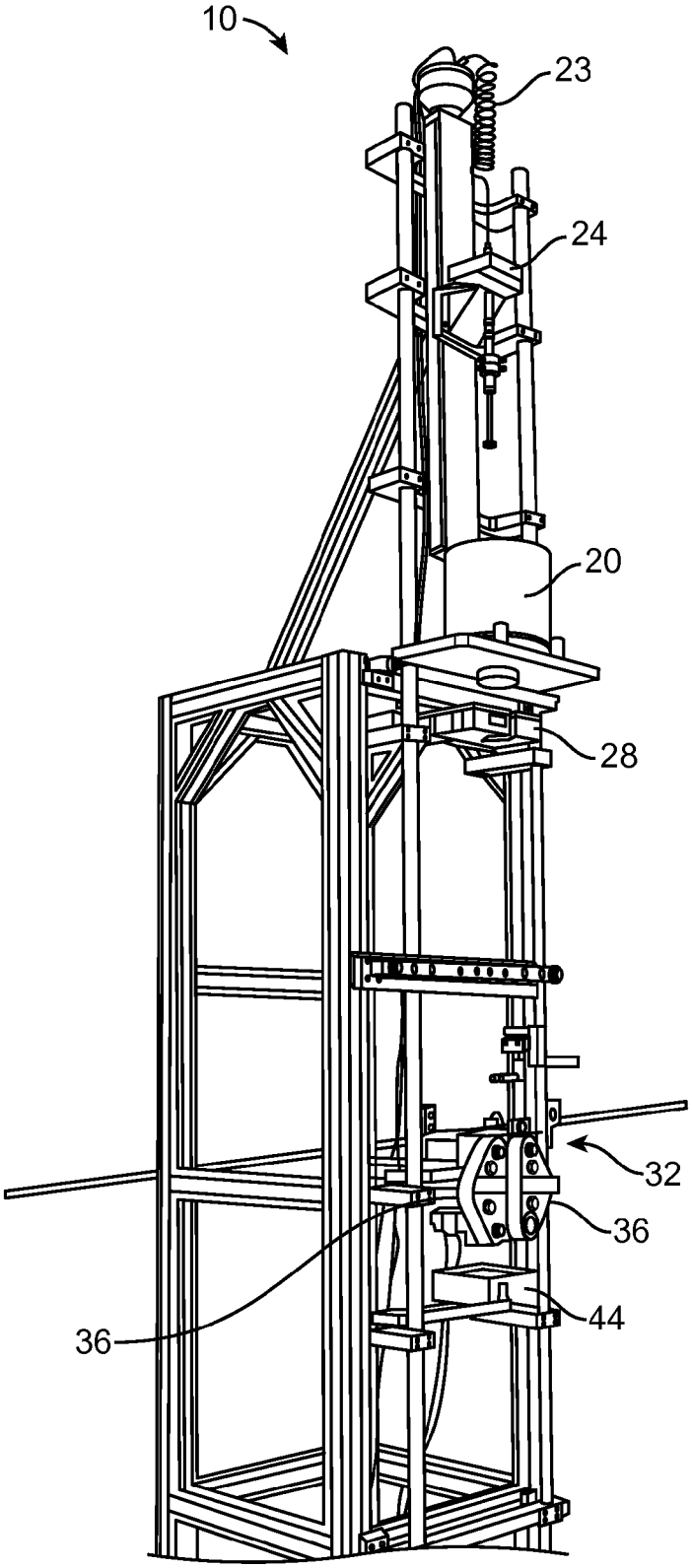
FIG. 2 is a perspective view of a drawing tower in accordance with an embodiment of the present invention.

A draw tower 10 suitable for use with the invention is shown in FIG. 2. The tower includes a furnace 20 having an opening for receiving the glass capillary tubes. A glass pre-form elevator 24 is used to lower the glass tube into the furnace and to raise it from the furnace when the pre-form draw is complete. A vacuum hose 23 can be provided and attached to the glass tube to create a vacuum in the tube during the drawing process. A laser micrometer 28 or other suitable measuring device is provided to carefully measure the diameter of the drawn tube. A tractor puller 32 or other suitable structure is provided to apply even drawing pressure on the wire.

The process can include pulling the uncoated wire, and once the glass starts coating the wire, the puller pulls the glass coated wire. The puller 32 has opposing tracks 36 which come together to engage the wire and move apart to disengage the wire. The opposing tracks 36 counter-rotate so as to both grip and pull the fiber through the furnace. The same tower 10 can be used to do the pre-form draw and the coated wire draw. A spool such as the spool 18 shown in FIG. 1(*c*) can be provided to spool the wire into the glass tube as needed. A fiber cutter 44 or other suitable device is provided to cut the drawn wire at appropriate lengths. This length can be programmed into the device such that the glass coated wire will be cut into equal lengths by the draw tower cutter.

Figure 3:
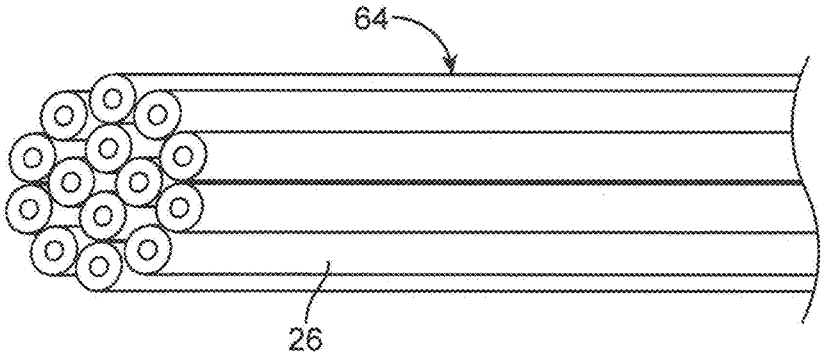
FIG. 3 is a perspective view of a fiber bundle.

A plurality of the glass coated wires 26 are then placed in a bundle 64, as shown in FIG. 3. The bundle can have any number of glass-coated wires 26. The number and position of the glass-coated 26 wires can vary. The glass coated wires can be evenly distributed throughout the bundle 64. Alternatively, the glass-coated wires 26 can be bundled with various other fiber combinations. For instance some of the bundled fibers may be solid glass fibers, while others may contain hollow core fibers. The hollow cores can be filled with another material to impart desired properties to the resulting device. The hollow cores could be filled with nearly anything, or left hollow. If left hollow, the hollow channels could be used to flow gases either onto or from the wire array surface. For instance, if the wire array was etched into wire cones and chemically treated to be superhydrophobic with a pinned layer of air surrounding the wires, any hollow channels could then be used to augment (increase or decrease) the amount of pinned air around the wires, effectively controlling the surface's water repellency by controlling the pinned air layer via the set of air channels within the array. The hollow core fibers could be bundled randomly or ordered. As an example, each $5^{th}$ fiber could be hollow and each $10^{th}$ fiber could be solid glass, and each $20^{th}$ fiber could have a different diameter of glass coating, or a different diameter of wire core, or a different type of were. An almost infinite number of permutations are possible to produced wire arrays with precisely engineered characteristics. Since the wire coating creates an intermediate fiber that gets bundled and fused with a group of other fibers, a bundle can be customized to have any number of different materials, structures, and characteristics.

Figure 4:
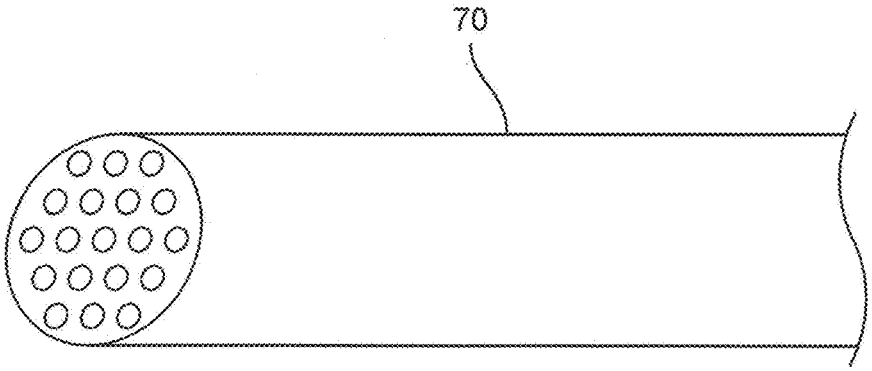
FIG. 4 is a perspective view of a fused rod.

Fusion of the bundle 64 into a rod is accomplished by placing the bundle 64 in the furnace at a temperature which depends of the type glass used. The temperature should be set just below the glass softening point temperature in a vacuum that causes the glass fibers to fuse together, for a time sufficient to soften and fuse the glass. The bundle can be fused from the bottom of the sealed tube so that a mild vacuum (or no vacuum) will allow any air in the tube to escape the top (unsealed) portion of the tube. The bundle 64 can be heated to a temperature sufficient to soften the materials comprising the bundle, but below a temperature where damage, decomposition, or other deleterious changes can occur. The bundle 64 of glass-coated wires 26 is thereby fused into a solid rod 70, as shown in FIG. 4. The product is a solid rod with few or no gaps or spaces.

Figure 5:
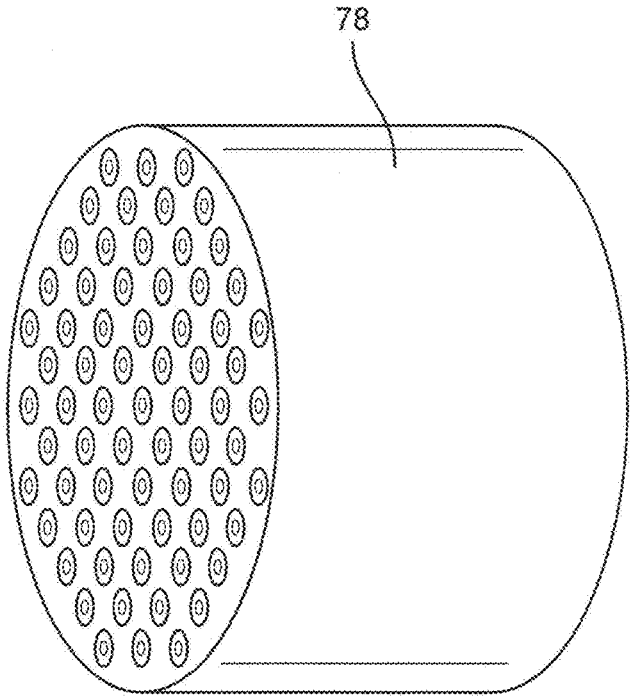
FIG. 5 is a perspective view of a wafer.

The fused-bundle or rod 70 may be sliced and polished to produce arrays of wires within a glass matrix. The slicing may be performed by suitable saws, blades, lasers or other precision cutting devices. A plurality of wafers 78 is produced, as shown in FIG. 5. The wafers can be cut to any desired thickness.

Additional thermal processing may be performed before or after slicing the bundle in order to anneal the material or produce a hermetic seal between the wires and the glass. Thermally annealing glass reduces internal stress and less stress generally reduces glass etch rates. Some glasses such as sodium borosilicate glass will slightly phase separate when heated (the closer the heating is to the glasses transition temperature, the higher the phase separation rate). The glass's etch rate directly relates to the amount of phase separation which can vary depending on the glass's thermal history.

Subsequent etching and or electrochemical processes may be used to further enhance the features of the wafers 78 containing the wire array. In particular these processes can be used to etch back the glass to expose the wires. Exposure of the wires is desirable to create electrical contacts to the wires, to create emitting devices such as field emitters, or to create any of various micromechanical devices that are possible with insulated exposed wires. The exposed wires can also be used as tools, such as for gripping.

Any suitable etching composition can be used. The etchant can comprise an organic or inorganic acid or alkali; polar, nonpolar, organic, inorganic, or mixed solvent; or mixtures of any of the foregoing. The etchant can be selected to etch the wire and glass material differentially as described herein. For example, an aqueous acid such as HF, HCl, HBr, or HI might be selected to etch glass and wire compositions differentially.

The etchant can be a "mixed etchant system" which is comprised of a plurality of etchants that give different etch contrast ratios when applied to the wire/glass surface. For example, one etchant can preferentially etch the glass phase while the other etchant can preferentially etch the wire. A mixed etchant system can be particularly useful because the contrast ratio of the etching process can be modified by changing the composition and/or relative concentrations of the etchants. An example of a mixed etchant system is a mixture of HF and HCl. The possible compositions of suitable mixed etchant systems are virtually without limits. It is alternatively possible to use sequential etching processes to etch the glass and metal, to use masking compositions to prevent etching of one material while permitting etching of another or varying the rate of etching by the use of making compositions or etching conditions.

Figure 6:
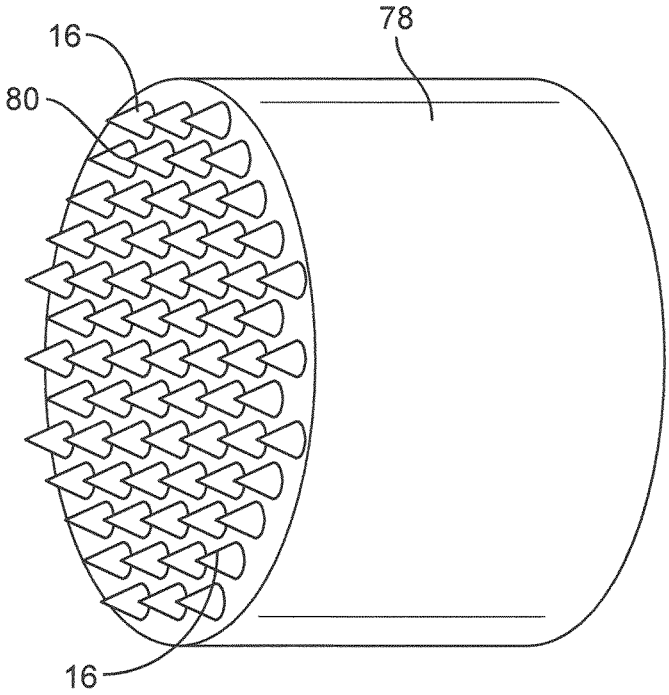
FIG. 6 is a perspective view of a wafer after etching.
Figure 7:
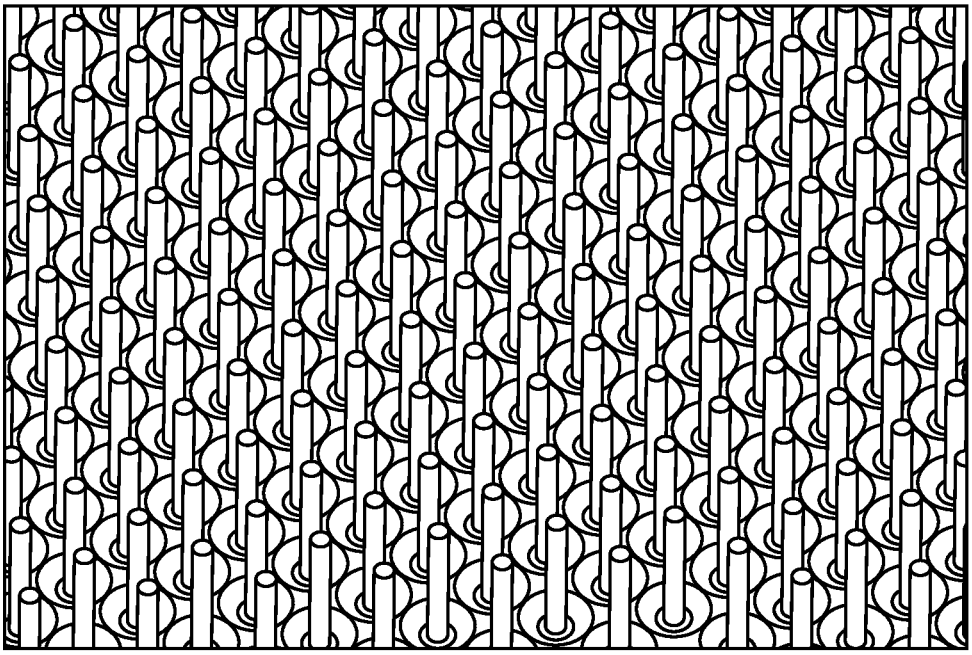
FIG. 7 is an image taken from a scanning electron microscope (SEM) showing a tungsten wire array in an etched wafer.
Figure 8:
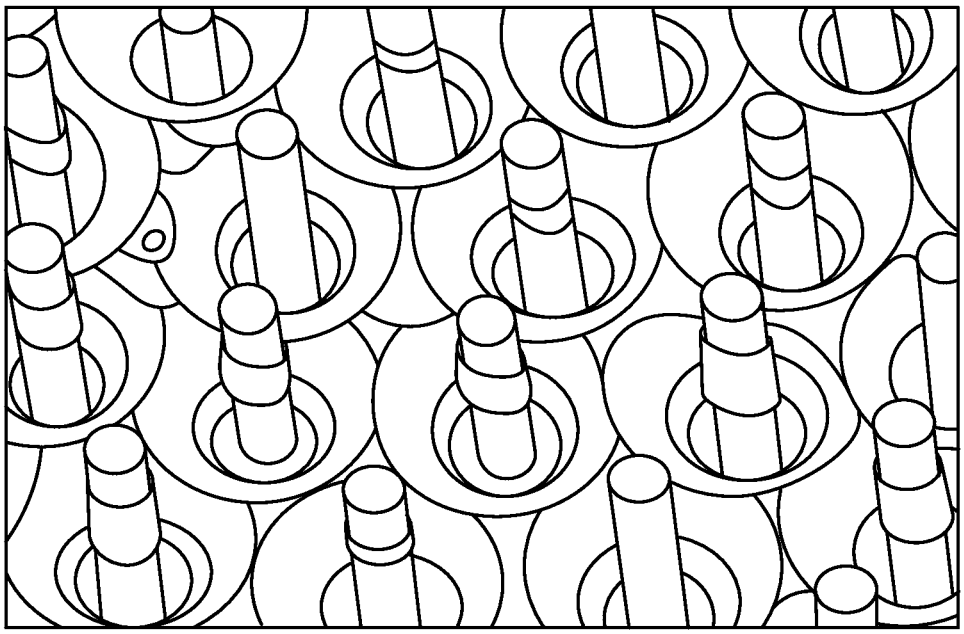
FIG. 8 is another SEM image showing a tungsten wire array in an etched wafer at an enlarged magnification.

The method by which the etching is carried out is not critical to the invention, as long as the desired surface feature is achieved. For example, other, non-solution etching techniques may be used, such as plasma etching or other isotropic etch techniques. The etching will expose the array of embedded wires 16 as depicted in FIG. 6 and shown in the SEM images shown in FIGS. 7 and 8.

Figure 9:
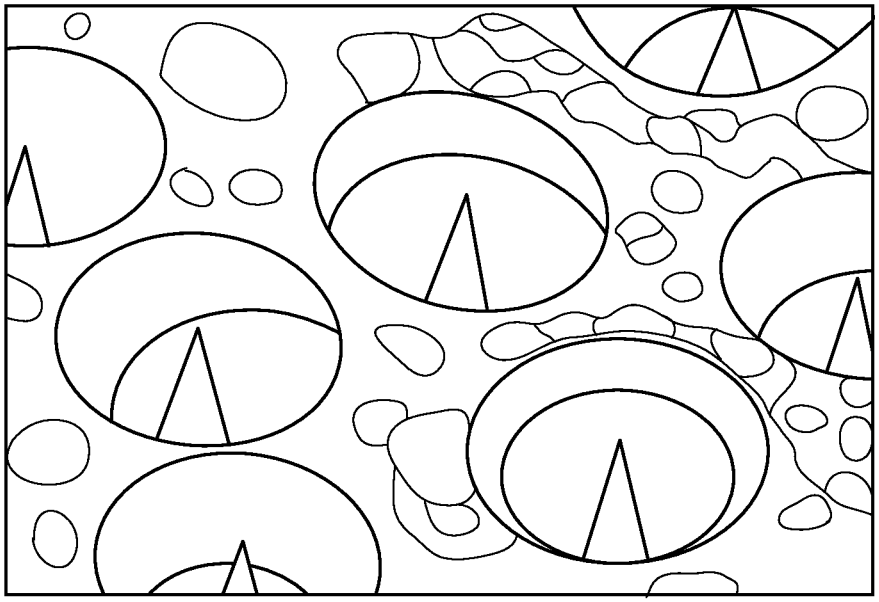
FIG. 9 is an SEM image showing a tungsten wire array in a glass matrix that has been etched to form pointed tips at the end of the wires.
Figure 10:
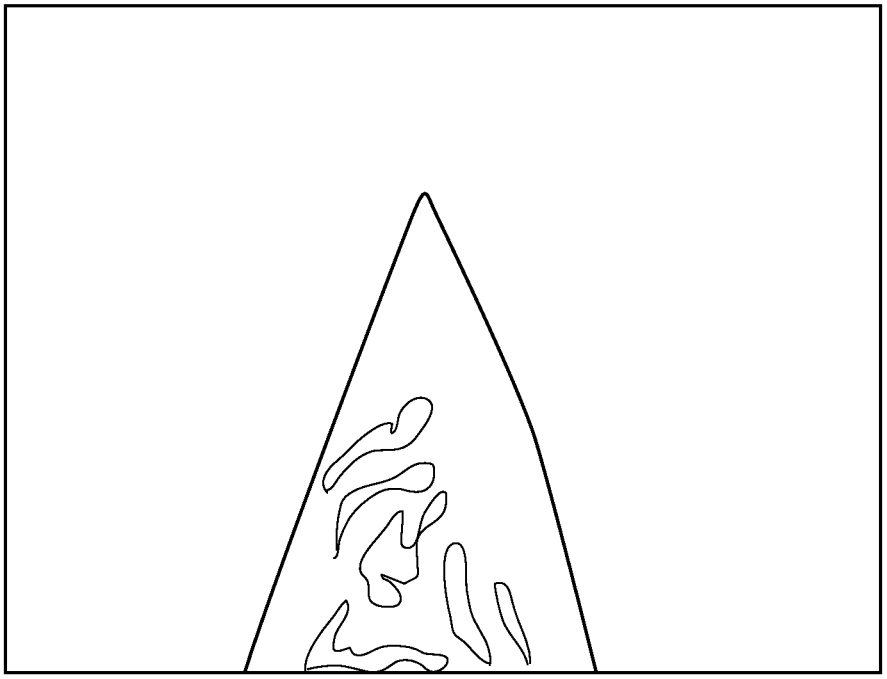
FIG. 10 is an SEM image of an etched wire with a pointed tip at a higher magnification.
Figure 11:
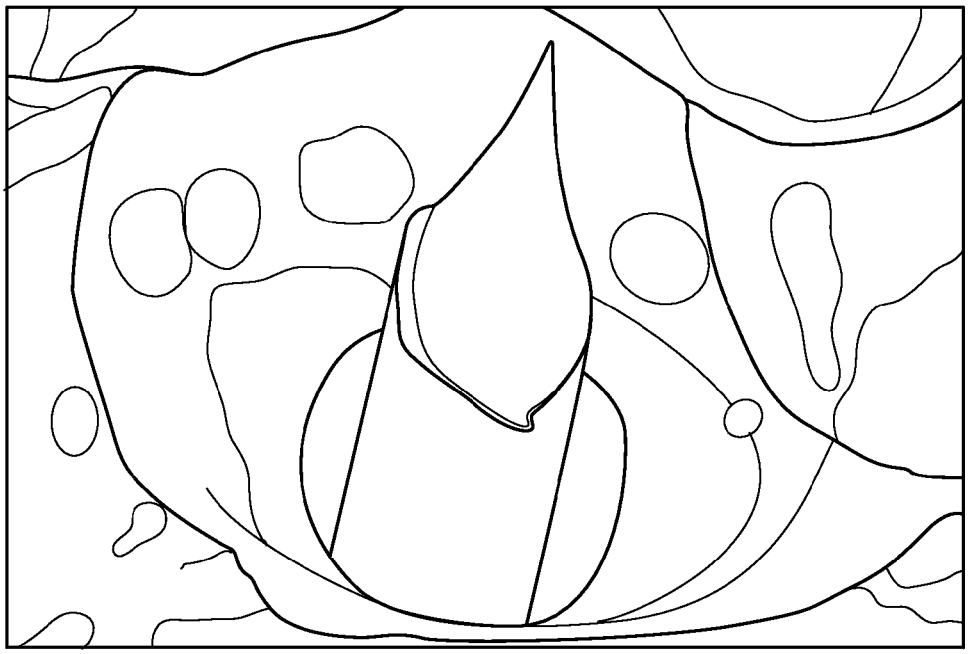
FIG. 11 is another SEM image showing an exposed and sharpened tungsten wire array.

For some uses it is desirable to sharpen the tips of the wires to points. The term "points" is defined herein to mean a generally tapered, protrusive structure that preferably terminates in a sharp terminus, ideally an atomically sharp point or ridge. "Point" can therefore refer to a wire having a base portion having a first cross sectional area, and a tip portion opposite the base portion having a reduced cross sectional area that is no more than 3% of the first cross sectional area, such as 2.5%, 2.0%, 1.5%, 1.0%, 0.8%, 0.6%, 0.5%, 0.4%, 0.3%, 0.2%, 0.1%, or less than 0.1% of the first cross sectional area. Such pointed tips 80 are depicted in FIG. 6 and also shown in the SEM images shown in FIGS. 9, 10 and 11. Any suitable process can be used to etch the wires 16 into pointed tips 80. This can include chemical etching processes or electrochemical etching processes.

Figure 12:
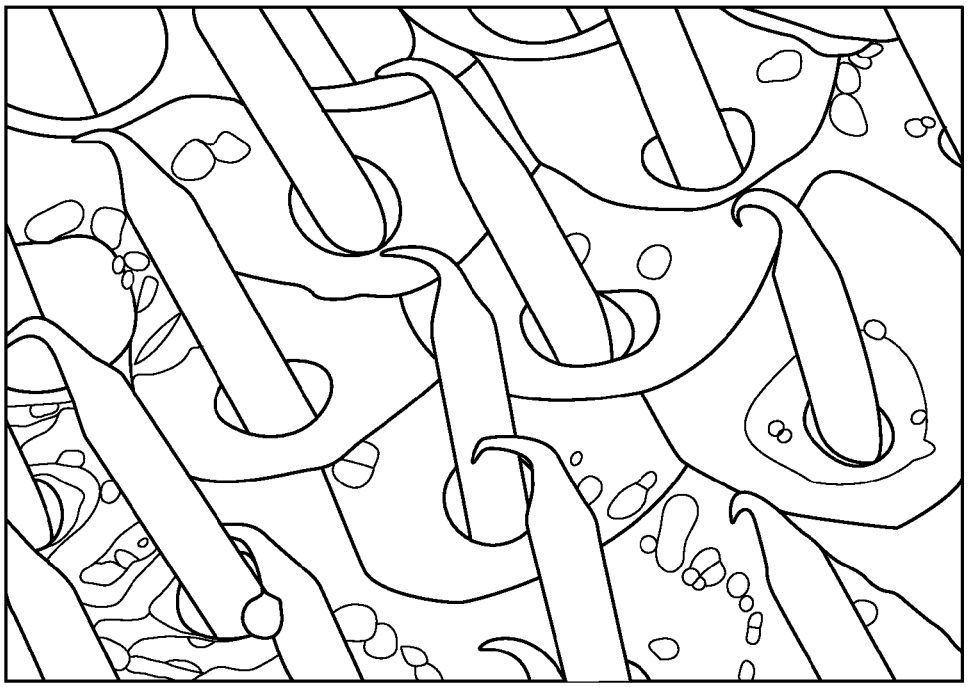
FIG. 12 is an SEM image showing a tungsten wire array with bent tips.
Figure 13:
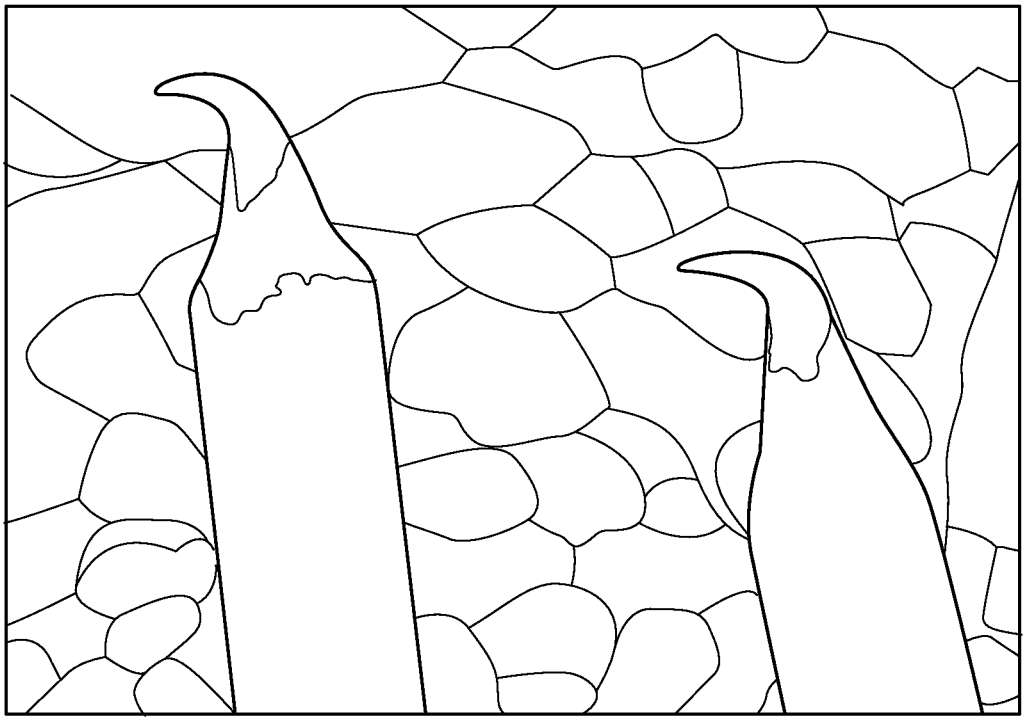
FIG. 13 is an SEM image showing a tungsten wire array with bent tips at an enlarged magnification.

For some uses such as gripping, hooks at the ends of the wires are desirable. Hooks are formed by applying force to the ends of the sharpened wires, perpendicular to their axis. A relatively soft object such as wood or a polymer material such as Teflon can be brushed across the protruding ends of wires with sufficient force to bend the tips. The tips of the wire array will be engaged by the material and bent to create a surface with directionally dependent engagement hooks. Such hooks are shown in the SEM images of FIGS. 12 and 13.

The size of the wafer is only limited by how much fiber is bundled prior to fusion. Since the wire is not actually being drawn, its final diameter is the same as the diameter of the original wire on the spool. The images shown in FIGS. 7-11 show wires with diameters of 75 μM. Wires with diameters as small as 5 μM are commercially available to be used with this method, and smaller wires if obtainable can be used. These arrays can be used as electrodes for a variety of devices. Since the wires extend all the way through the wafer, energizing or sensing the electrode is accomplished by simply connecting to it via the back-plane. Arrays of both tungsten and platinum wires have been created. Tungsten is widely used as a field emission electrode. Platinum is widely used as a medical (implant) electrode.

EXAMPLE

The wire bundle begins as a glass tube (for example a 9 mm outer diameter and 2.2 mm inner diameter Corning Pyrex capillary tube) and a length of metal wire which has a diameter smaller than the inside diameter of the tube (for example a 0.003 inch diameter 316 stainless steel wire). The wire is threaded at least partially through the tube and drawn in a fiber draw tower into fiber (for example a 0.3 mm diameter fiber). In the drawing process, the metal wire is pulled with the drawn fiber and is incorporated into the glass fiber. The draw parameters can be chosen such that in the absence of the metal wire, the inside diameter of the drawn tube would be similar to or smaller than the diameter of the wire.

The fiber with a metal core is cut into short pieces (for example 100 mm long). The pieces are bundled together in a glass tube (for example a 9 mm outer diameter, 7 mm inside diameter Pyrex tube). The inside of the tube is evacuated and the tube is heated (for example in a furnace) so that the tube collapses around the bundle and the bundle is fused together. If the fusion is done in a gas atmosphere, an outside tube can be provided to encase the bundled pieces and permit the drawing of a vacuum inside outer tube. The outer tube will be drawn with the pieces to form an integrated whole. If the process is performed in a vacuum chamber an outer tube is not necessary. In this process any remaining air between the wires and the glass coatings is removed and the glass may form a hermetic seal with the wire. The bundle is sliced perpendicular to the fiber direction. The slices may be shaped, and the glass can be etched back (for example with hydrofluoric acid) to reveal the protruding metal wires.

For some uses, the tungsten wires require sharpening. This is done by first etching away part of the outer glass. The tungsten wires are then sharpened by an electrical-chemical etching method. The wire is sharpened because the wire etches in the process, but at a slower rate than the glass and because the distal tip is exposed for a greater period of time than the base portion as the glass must be removed before significant surface area of the wire can be etched. Finally, the glass matrix can be once again etched back to fully expose the sharpened electrodes. The metal wire arrays can be sharpened using electrochemical etching. Tungsten wires were coated with glass and then the fibers were fused together as described earlier. Then wafers were cut (for example at 3 mm) from the fusion using a diamond saw and polished on both sides. The wafer was then etched on one side using hydrofluoric acid (HF) which removes the glass and does not damage the tungsten wire. However the etching created circular craters around the wires. Next the tungsten wires are electrochemically etched into points. Finally, the glass matrix is once again etched back to fully expose the sharpened electrodes. An etchant or etchant mix could be used to etch the wires into sharp points while the glass is etched back to produce protruding metal points.

It is critical that all the wires are in electrical continuity, if not then some of the wires will not be etched. To assure good continuity, the back side of the wafer is sputter coated with gold and pressed into a soft sheet of indium foil. The wafer and foil are inverted in a brass holder which is connected to a potential source. Next the wafer is lowered into a sodium hydroxide bath (2.0 M) containing a platinum counter electrode. A potential of 5 v is placed across the tips of the tungsten wires and the platinum electrode. This causes the tungsten wires to sharpen to points which are located at the glass interface with a conical shape in the crater. Next the surface is etched in HF again to expose the tungsten wire tips.

Wire bundles with 300 micron spacing have been demonstrated, and the spacing can also be varied in a controlled manner. The wires may form a hermetic seal with the glass to produce sealed feed-throughs. There is electrical continuity of the wires through the wafers. The bundle can be very thick such that thicknesses of many mm or even cm are possible. The wafers are durable, so the surface can be ground and polished to a desired shape, for example to match the shape of the retina. The glass can be etched back to expose electrodes for contact or bonding, to create a multitude of possible devices. The fraction of metal (the ratio of wire diameter to wire spacing) can be varied, again in a controlled and predictable manner. The fabrication method is inherently scalable for manufacturing.

The finished slices can be used for electronic devices, microfluidic devices, or as an electrode array for medical implants or microsurgery tools, or as a field emission device and display devices. Other devices are possible.

Electronic Devices

The field emission characteristics of the wire arrays was characterized. The back side of the wafer was activated by adhering it to a metal plate using a conductive epoxy. Next the sample was placed under a 10-7 torr pressure vacuum. The field emission from individual tips is measured by placing a potential between the tips of the sample and a movable needle. The x-y-z position of the sample relative to the needle is controlled to confirm that only one tip is measured at a time. Results show that the turn on voltage is about 15 volts/micron. Examples of such devices can be found in U.S. patent application Ser. No. 13/420,219 entitled "Vacuum Field Emission Devices and Methods of Making Same" filed on even date herewith. The disclosure of this application is incorporated fully by reference.

The method is an excellent way to fabricate a variety of electronic devices without using photolithography. Each tip is individually addressable from the back side of the wafer. Tungsten is a desirable wire metal for electronic devices due to it high melting point and durability.

Forceps

During surgery, forceps are use to remove the Epiretinal Membranes from the Retina (EMR). However these standard forceps can damage the retina if the retina is pinched while the EMR is removed. Wire arrays according to the invention can be applied to or used with existing products such as forceps wherever the device will contact the item to be gripped. An example of such a device is an eye surgical device. For this device the tips would generally be uniformly bent in a single direction. The hooks will engage when contacted in a direction opposite to the orientation of the hooks, and will not engage or will engage less vigorously when contacted in any other direction. The direction of bending of the hooks could be arranged in a variety of ways such as concentric circles. A torque on this surface would cause the hooks to engage the surface.

A forceps according to the invention can be fabricated and sharpened as described above. A metal wire array composed of matrix bound sharpened wires with all of the tips bent in a common direction is used as a holding/grabbing/securing surface and has enhanced gripping capabilities in a preferred direction. The large number of these closely spaced hooks temporarily embeds in the surface of a material with very little normal pressure to the array surface. This can improve the ability of tools such as forceps, tweezers or hemostats to hold on to slick or delicate materials with a minimum of squeezing force or pressure. The ductile tips of the hooks would bend rather than break off if a hard object and or high force is encountered.

These closely spaced tips would have multiple points per area to distribute higher overall gripping forces. The points would have equal gripping capabilities in any direction parallel to the surface. The shape of these points would be less susceptible to bending or damage, resulting in a tougher and more durable surface. The surface would tend to exhibit higher friction for holding on to other materials. The second advantage of the design is that the variable height, and pitch ratios of the instrument mean that one can be selected that is specific for the patient's exact pathology. If the EMR is 10 μM, for example, the device can be made to the same dimensions. An instrument made of many small glass cones angled at 30-60, or 45 degrees can act to engage the EMR across a wider area without damaging the retina. Other advantages of such a device over traditional forceps include: (1) it does not pinch the tissue, rather, it engages the entire tissue at once, in multiple sites; (2) because of its design, the instrument cannot penetrate any deeper into the tissue than the maximal height of the spikes; and (3) glass is entirely inert in the eye. It also can be sterilized and is disposable.

Microfluidic manipulations can be performed by using wire arrays where the glass is etched back and a hydrophobic coating is added. Voltage applied to the back of the electrode array can be used to manipulate liquid drops on the surface. This process is known as electro wetting on dielectric (EWOD).

While there has been shown and described what are at present considered the preferred embodiments of the invention, it will be obvious to those skilled in the art that various changes and modifications can be prepared therein without departing from the scope of the inventions defined by the appended claims.

We claim:

1. A method of making a wire array device, comprising steps of:

providing a tube of a sealing material, the tube having an interior surface;

positioning a wire in the tube, the wire having an exterior surface, wherein the wire material has a melting point higher than the melting point of the sealing material and an outside diameter of the wire is less than an inside diameter of the tube, wherein voids are present between the wire and the tube;

heating and softening the tube and drawing the softened tube to bring the interior surface of the tube into contact with the exterior surface of the wire to create a coated wire;

bundling the coated wire to form a plurality of bundled individually coated wires comprising voids between the coated wire;

heating the plurality of bundled individually coated wires to fuse the sealing material coating the coated wire to create a solid fused rod with an array of the wire embedded within a solid matrix of sealing material, with the sealing material separating the wire from contact with each other;

wherein voids between the tube and the wire and voids between the bundled coated wire are removed; and, further comprising a step of cutting the fused rod into wafers, to make the wire array device.

2. The method of claim 1, wherein prior to the drawing step the tube is heated and drawn to form a pre-form tube having an inside diameter less than the inside diameter of the tube.

3. The method of claim 1, wherein the drawing step comprises first engaging and pulling the wire, and subsequently engaging and pulling the coated wire.

4. The method of claim 1, further comprising the step of removing end portions of the sealing material to expose end portions of the wires.

5. The method of claim 4, wherein portions of the exposed wires are removed to form a pointed end.

6. The method of claim 4, wherein said removal step is by etching.

7. A method of making a wire array device, comprising steps of:

providing a tube of a sealing material, the tube having an interior surface;

positioning a wire in the tube, the wire having an exterior surface, wherein the wire has a melting point higher than a melting point of the sealing material;

heating and softening the tube and drawing the softened tube to bring the interior surface of the tube into contact with the exterior surface of the wire to create a coated wire;

bundling a plurality of the coated wire to form bundled coated wires comprising voids between the coated wires;

heating the bundled coated wires to fuse the sealing material coating the wire and remove the voids between the coated wire to create a solid fused rod with an array of the wire embedded therein;

further comprising a step of removing end portions of the sealing material to expose end portions of the wires, wherein portions of the exposed wires are removed to form a pointed end, and wherein the pointed wires are bent such that an axis of the pointed end is at least 30 degrees from the axis of the wire, to make the wire array device.

8. The method of claim 1, wherein the parameters of the draw are selected such that in the absence of the metal wire the inside diameter of the drawn tube would be similar to or smaller than the diameter of the wire.

9. The method of claim 1, wherein the diameter of the wire is between 1 and 200 μM.

10. The method of claim 1 wherein the sealing material is selected to wet the wire.

11. A method of making a wire array device, comprising the steps of:

providing a tube of a sealing material, the tube having an interior surface;

positioning a wire in the tube, the wire having an exterior surface, wherein the wire has a melting point higher than the melting point of the sealing material;

heating and softening the tube and drawing the softened tube to bring the interior surface of the tube into contact with the exterior surface of the wire to create a coated wire;

bundling a plurality of the coated wires to form bundled coated wires comprising voids between coated wire;

heating the bundled coated wires to fuse the sealing material coating the wire and remove the voids between coated wire to create a solid fused rod with an array of the wire embedded therein;

wherein a coefficient of thermal expansion (CTE) difference between the sealing material and the wire is $\Delta CTE<1\text{-}5\times10\text{-}7/^{\circ}$ C., to make the wire array device.

12. The method of claim 1, wherein the tube is heated to a temperature that is less than the melting point of the wire (Tm), but above the glass transition temperature of the glass (Tg).

13. The method of claim 1, wherein the sealing material is glass.

14. The method of claim 13, wherein the glass is at least one selected from the group consisting of Corning Pyrex, Schott 8330, Schott Fiolax, Schott 8487, or soda lime glass.

15. The method of claim 1, wherein the wire comprises at least one selected from the group consisting of platinum, iridium, platinum-iridium alloy, stainless steel, tungsten, and mixtures or alloys thereof.

16. The method of claim 1, wherein a vacuum is applied to the tube during the drawing step.

17. The method of claim 1, wherein tubes filled with a material other than the wire material are bundled with the coated wires prior to the fusing step.

18. The method of claim 1, wherein hollow tubes are bundled with the coated wires prior to the fusing step.

19. The method of claim 1, wherein solid rods of the sealing material are bundled with the coated wires prior to the fusing step.

* * * * *